US007387703B2

(12) United States Patent
Koskinen et al.

(10) Patent No.: US 7,387,703 B2
(45) Date of Patent: Jun. 17, 2008

(54) METHOD FOR MANUFACTURING BASE PAPER FOR RELEASE PAPER

(75) Inventors: Timo Koskinen, Grand Rapids, MN (US); Kaj Koskinen, Valkeakoski (FI); Pekka Aho, Jämsänkoski (FI); Seppo Särelä, Valkeakoski (FI)

(73) Assignee: UPM-Kymmene Corporation (FI)

( * ) Notice: Subject to any disclaimer, the term of this patent is extended or adjusted under 35 U.S.C. 154(b) by 501 days.

(21) Appl. No.: 10/997,696

(22) Filed: Nov. 24, 2004

(65) Prior Publication Data

US 2005/0126729 A1 Jun. 16, 2005

Related U.S. Application Data

(63) Continuation of application No. PCT/FI03/00379, filed on May 16, 2003.

(30) Foreign Application Priority Data

May 29, 2002 (FI) ..... 20021005

(51) Int. Cl.
*D21H 19/78* (2006.01)
*D21H 19/12* (2006.01)
*D21H 19/82* (2006.01)

(52) U.S. Cl. ..... 162/135; 162/137; 162/158; 162/205; 162/206

(58) Field of Classification Search ..... 162/119, 162/135–137, 158, 175, 183, 184, 204–206, 162/358.1, 361; 100/71, 73–75; 427/326, 427/355, 361, 391, 395

(56) References Cited

U.S. PATENT DOCUMENTS

| | | | | |
|---|---|---|---|---|
| 3,925,328 | A * | 12/1975 | Shibahara et al. | 524/52 |
| 4,387,132 | A * | 6/1983 | Hain | 428/211.1 |
| 4,474,847 | A * | 10/1984 | Schroder et al. | 428/32.35 |
| 4,935,097 | A * | 6/1990 | Tashiro et al. | 162/135 |
| 5,102,502 | A | 4/1992 | Reinhardt et al. | |
| 5,200,258 | A * | 4/1993 | Tamagawa et al. | 428/218 |
| 5,505,820 | A * | 4/1996 | Donigian et al. | 162/206 |
| 5,954,921 | A * | 9/1999 | Dahmen et al. | 162/168.2 |
| 6,989,076 | B2 * | 1/2006 | Moring et al. | 162/135 |

FOREIGN PATENT DOCUMENTS

| | | |
|---|---|---|
| FI | 108361 | 1/2002 |
| FI | 108873 | 4/2002 |
| WO | WO 01/29317 | 4/2001 |
| WO | WO 01/98585 | 12/2001 |

* cited by examiner

*Primary Examiner*—Eric Hug
(74) *Attorney, Agent, or Firm*—Fitch, Even, Tabin & Flannery

(57) ABSTRACT

In a method for manufacturing base paper for release paper, the body layer, which is formed of a fibre raw material, is surface sized with a surface treatment agent. Before the surface sizing, the body layer, whose moisture level is at least 13 wt. %, is calendered in a calender that comprises at least one nip formed between a hard-faced roll and a soft counter surface.

18 Claims, 1 Drawing Sheet

METHOD FOR MANUFACTURING BASE PAPER FOR RELEASE PAPER

This application is a continuation of International Application No. PCT/FI03/00379, filed May 16, 2003.

The invention relates to a method for manufacturing base paper for release paper, wherein a body layer, which is formed of a fibre raw material, is surface sized with a surface treatment agent.

BACKGROUND

Release papers are used e.g. as backing papers for adhesive labels. The base paper is coated with silicone usually with a solvent-free silicone system. As this method has become more common, the surface properties of the base paper for the release paper have become more significant in achieving a good siliconized surface quality. Due to the properties of silicone, the low porosity, low water and oil absorptivity, and high smoothness of the base paper have become more important.

The functional demands on the base paper for release paper are complex, due to a wide range of usage and difficult applications. The essential properties of base paper include: strength properties (also after thermal treatment), dimensional stability, high density, barrier properties, chemical suitability for siliconization, high transparency, low porosity, and good smoothness. A well-functioning base paper is passed without breaks on a converting machine, requires little silicone for good silicone coverage, functions without problems in die cutting of a laminate, and does not cause problems in labelling.

To improve the quality of the base paper, it is known to surface size the surface, which receives the release agent, with a suitable substance and to calender it after the surface sizing. The quantity of surface size in the base paper is typically at a level of approximately 3 g/m$^2$/side, calculated as the amount of dry matter. The surface size agents are, however, relatively expensive, and therefore it would be beneficial to decrease the quantity of the surface size. Even if a substantial quantity of surface size were used, there is the possibility that there are pores in the base paper, which prevent a good silicone coverage, in which case the adhesive penetrates the pores, and the releasability of the label from the release paper declines.

SUMMARY

By means of the method for manufacturing base paper for release paper according to the invention, it is possible to avoid the above-mentioned problems and to decrease the quantity of surface size. The method according to the invention is characterized in that the body layer, whose moisture level is at least 13 wt. %, is calendered before surface sizing in a calender that comprises at least one nip that is formed between a hard-faced roll and a soft counter surface.

The base paper manufactured with the method according to the invention is calendered before the surface sizing so that its surface becomes smooth and the pores on the surface of the paper close up. Thus, the need for surface size decreases at the same time, however, as it closes the rest of the pores as well and provides the base paper, before it is treated with a release agent, with such a pre-treatment that the release agent will have a good coverage. Also, the need for release agent decreases. The adhesive applied on the surface of the release agent is prevented from penetrating the pores of the base paper, in which case releasing the label is easy. Because the need for both the surface size and the release agent decreases, the expenses of the manufacturing process decrease. In addition, the amount of energy required for drying the base paper after surface sizing is small, because the quantity of the surface size is small.

A paper grade, which is known as glassine paper, is manufactured with the method according to the invention. The base paper according to the invention comprises a body layer, which is first treated with a calendering treatment to close the pores and to reduce the surface roughness. After this, the body layer is surface sized. The surface sizing is performed preferably with a film size press, after which the surface size is dried. The quantity of surface sizing agent calculated as dry solids is generally less than 0.7 g/m$^2$/side, preferably less than 0.5 g/m$^2$/side. After this, the base paper can be calendered, preferably it is processed lightly in a calender of one or two nips. There can be a hard or a soft nip in the calender. Instead of processing one side of the body layer, it is possible to process the body layer on both sides, in which case there is a surface sizing on both surfaces of the base paper.

The body layer is calendered before it is surface sized in a calender with more than one nip. The calender comprises at least one nip that is formed between a hard-faced roll and a soft counter surface. The hard-faced roll is typically a heated metal roll. The soft counter surface can be, for example, a roll with a paper surface, a roll with an elastic surface, a belt, or a shoe roll. The surface of an elastic roll is typically composed of a polymer surface. The body layer brought to calendering has a moisture range of at least 13 wt. %, because otherwise the transparency required of a release paper is not reached. An advantageous minimum of the moisture range is 14 wt. %, generally the moisture range for a body layer brought to calendering is 15 to 20 wt. %. A suitable moisture level can be reached either by drying the body layer in the dryer section of the paper machine in such manner that it remains suitably moist, or by moistening a body layer dryer than the required moisture before calendering. The linear pressure used in calendering is usually not higher than 500 kN/m, but the linear pressure is determined e.g. on the basis of the type of calender being used. The temperature of the heated counter surface in the calender can be 250 to 300° C. For example, good results have been achieved with pressures of 50 to 70 Mpa in the nip and with temperatures of 90 to 100° C. in the heated rolls.

Advantageously, the calendering is conducted in a supercalender or a multinip calender. In connection with the calendering, it is possible to moisten the paper with steam or by spraying water. The term supercalender refers to a calender with several nips, in which hard and soft rolls alternate. The supercalender may also contain nips, typically only one, in which the nip is formed between two soft-faced rolls. The soft roll can be a roll with a paper surface (filled roll), or an elastic roll with a polymer surface. The same calender may contain both rolls with a paper surface and rolls with a polymer surface. The supercalender typically comprises 9 to 12 rolls. The supercalender is typically an off-line calendar.

The term multinip calender refers to calenders that contain several nips and that comprise nips formed between a hard-faced heated roll and a roll with an elastic surface. The roll with an elastic surface is typically a polymer coated roll. Multinip calenders can be on-line or off-line calenders. Such calenders include, for example, the Janus calender (Voith-Sulzer), the Prosoft calender (Küsters-Beloit), and the Opti-Load calender (Metso Paper).

Polyvinyl alcohol or various latexes are preferably used as the surface size. The known surface sizing formulas can comprise, for example, polyvinyl alcohol (PVA), carboxymethyl cellulose (CMC), various latexes and pigments, such as talc. Suitable latexes include, for example, styrene/butadiene, acrylate, styrene-acrylate and polyvinyl/acetate latexes. The characteristics of release paper can be tested, e.g. for Bekk porosity, IGT stain length correlating with the surface smoothness, and Unger oil absorption. In addition, tests can be performed with a Shirlastain test, which is generally used in testing the hydrophobicity of the surface of siliconized papers, based on the absorption of an aqueous test solution.

BRIEF DESCRIPTION OF THE FIGURES

The invention will be described in the following with reference to the appended drawings, in which.

The figures are presented to illustrate the field of use of the invention, and the relative sizes of elements therein are not intended to represent a real situation.

DETAILED DESCRIPTION

Figure 1:
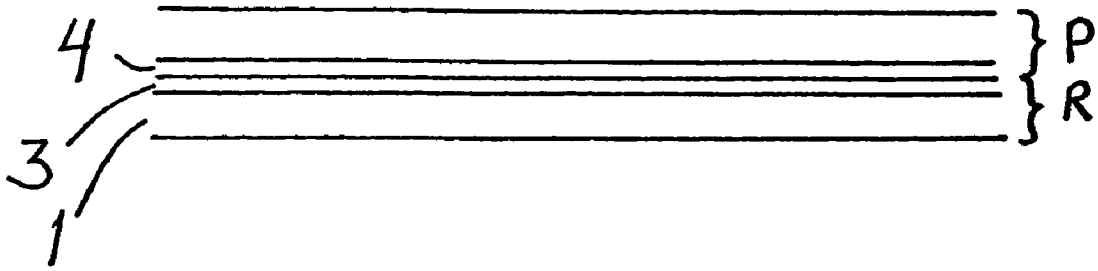
FIG. 1 shows, in a schematic cross-section, one possible adhesive label product, in which the release paper can be used.

According to FIG. 1, an adhesive label product consists of a surface paper P having an adhesive layer 4, and a release paper R having a release agent layer 3 on the surface of the base paper 1, which layer is against the adhesive layer 4. On the other side of the surface paper P, text and/or patterns can be printed by various printing methods.

Figure 2:
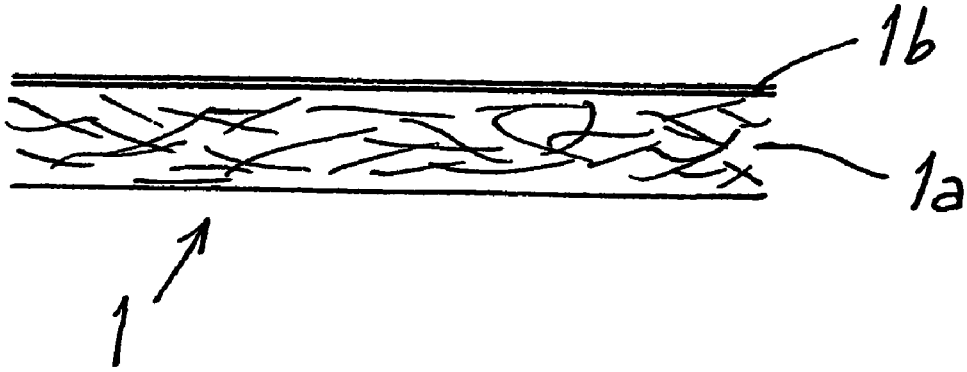
FIG. 2 shows the release paper in a schematic cross-section.

FIG. 2 shows the base paper 1 for the release paper R intended for the adhesive label product of FIG. 1. The base paper 1 has a body layer 1*a*, which is formed of a suitable fibre raw material, for example of cellulose-based paper pulp. The body layer 1*a* is preferably an uncoated paper made of chemical pulp, for example a mixture of softwood pulp and hardwood pulp. The surface sizing 1*b* is performed at least on that side of the paper on which the layer 3 of release agent is formed. In connection with the surface sizing, the body layer 1*a* can also be sized on the other side to prevent curling. The base paper 1 is calendered before the surface sizing. The grammage of the obtained base paper 1 is usually from 50 to 90 g/m$^2$.

EXAMPLES

Example 1

The application of surface size on the surface of the base paper is performed with a manual rod. 1 g/m$^2$ of starch is used as the surface size. The base paper is lightly calendered after surface sizing as well, in order to even out the surface. The results of the characteristics of the base paper are shown in Table 1.

TABLE 1

Results of the base paper test.

| Test method | Calendered, non-surface sized base paper | Calendered, surface sized base paper |
|---|---|---|
| Bekk porosity (s) average*) | 35.7 | 110.7 |
| Unger oil absorption, 60 s (g/m$^2$) Average**) | 1.76 | 0.63 |
| Bekk smoothness (s) Average*) | 1575 | 2629 |
| PPS 10 roughness (μm) Average*) | 1.39 | 1.16 |
| IGT stain length (cm) Average*) | 12.3 | 13.6 |
| Transparency (%) Average*) | 46.6 | 45.5 |
| IR transparency (V) (average) average*) | 0.136 | 0.143 |
| IR transparency (V) (min) average*) | 0.127 | 0.136 |

*)number of tests 4
**)number of tests 2

Example 2

Calendered, surface sized base paper (the base paper is the same as in example 1), whose grammage was 69 g/m$^2$ and the quantity of surface size 0.33 g/m$^2$/side, was examined in relation to its characteristics. Polyvinyl alcohol and a mixture of carboxy-methyl cellulose were used as surface size. The results are shown in Table 2.

TABLE 2

Results of the base paper test.

| Test method | Calendered, surface sized base paper | |
|---|---|---|
| | average | deviation |
| Bekk porosity (s)*) | 49.9 | 8.29 |
| Unger oil absorption, 60 s (g/m$^2$) Average**) | 1.1 | 0.0 |
| Bekk smoothness (s) Average*) | 1928 | 131.97 |
| PPS 10 roughness (μm) Average*) | 1.30 | 0.03 |
| Transparency (%) Average*) | 43.3 | 0.11 |
| IGT stain length (cm) Average*) | 12.5 | 0.19 |
| IR transparency (V) (average) average*) | 0.143 | 0.003 |
| IR transparency (V) (min) average*) | 0.132 | 0.003 |

*)number of tests 5
**)number of tests 2

Example 3

Calendered, surface sized base paper was examined in relation to its characteristics (the base paper is the same as in example 1). Polyvinyl alcohol and a mixture of carboxymethyl cellulose were used as surface size. The amount of surface size was 1.1 g/m$^2$/side. The results are shown in Table 3.

TABLE 3

Results of the base paper test.

| Test method | Calendered, surface sized base paper average | deviation |
|---|---|---|
| Bekk porosity (s)*) | 3056.6 | 331.85 |
| Unger oil absorption, 60 s (g/m$^2$) Average**) | 0.25 | 0.07 |
| Bekk smoothness (s) Average*) | 3046 | 202.09 |
| PPS 10 roughness (μm) Average*) | 1.15 | 0.04 |
| IGT stain length (cm) Average*) | 14.2 | 0.26 |
| Transparency (%) Average*) | 45.6 | 0.29 |
| IR transparency (V) (average) average*) | 0.140 | 0.004 |
| IR transparency (V) (min) average*) | 0.155 | 0.003 |

*)number of tests 5
**)number of tests 2

Example 4

In manufacturing the adhesive label product, the surface paper of the label product and the base paper of the release paper according to the invention are introduced to the production line as rolls with a fixed width and length. The base paper is first coated in a roll coating unit with a release agent, typically a silicone layer, which is polymerised and cured at 140° C. in an oven. The quantity of silicone applied is about 1 g/m$^2$. In this way, a release paper is obtained whose surface is provided with a layer of the release agent. Next, the release paper is coated with an adhesive layer on its release agent layer side. The adhesive is normally an aqueous dispersion, from which extra water is evaporated in a dryer. After the drying, the web is passed through a wetting unit to achieve a suitable moisture level. The back paper and the surface paper are laminated together by running them between rolls, which press the layers together. The ready laminate is collected on a roll. The laminate can be reprocessed in a variety of ways, such as, for example, printed with a printing machine. It is also possible to punch out labels of suitable size from the laminate after the printing. The release paper provided with a release agent layer can also be introduced as a ready product to the production line and be combined there with the surface paper of the label product.

The above description is not restricting to the claims. The main idea in this invention is that by calendering the body layer before the surface sizing, it is possible to provide a good quality base paper, wherein the quantity of surface sizing agent is small.

The invention claimed is:

1. A method for manufacturing a surface sized release paper, the method comprising:

calendering a body layer in a calender that includes at least one nip formed between a hard-faced roll and a soft counter surface to provide a calendered release paper, the calendered release paper being formed of fibre raw material and having a moisture level of at least about 13 wt. % to provide a grammage of the calendered release paper of from about 50 to about 90 g/m$^2$;

surface sizing the calendered release paper with a surface sizing treatment agent to provide the surface sized release paper, the quantity of the surface sizing treatment agent being less than about 0.7 g/m$^2$ as dry solids to form the surface sized release paper, the calendered release paper having pores which will not absorb the surface sizing treatment agent when the agent is applied thereto as much as a release paper from the same body layer which has not been calendered with a moisture level of at least 13 weight percent and which has been surface sized with less than about 0.7 g/m$^2$ surface treating agent; and applying a release composition to the sized surface of the release paper to provide a release agent surface, the release agent surface not absorbing an adhesive when an adhesive is applied thereto as much as a release paper from the same body layer which has not been calendered with a moisture level of at least 13 weight percent, which has been surface sized with less than about 0.7 g/m$^2$ surface treating agent and which has not been coated with same amount of a release agent in the same way.

2. The method according to claim 1, wherein the body layer is calendered in a supercalender or a multinip calender.

3. The method according to claim 1, wherein the body layer is calendered in a shoe calender or a belt calender.

4. The method according to claim 1, wherein the surface sizing comprises polyvinyl alcohol.

5. The method according to claim 4, wherein after the surface sizing, the base paper is calendered again.

6. The method according to claim 5, wherein the body layer is a chemical pulp selected from the group consisting of softwood pulp, hardwood pulp and mixtures thereof.

7. The method according to claim 1, wherein the quantity of the surface sizing agent is less than about 0.5 g/m$^2$.

8. In a method for manufacturing a surface sized release paper, the method comprising:

calendering a body layer in a calender that includes at least one nip formed between a hard-faced roll and a soft counter surface to provide a calendered release paper, the calendered release paper comprising chemical pulp made from a source pulp selected from the group consisting of softwood pulp, hardwood pulp and mixtures thereof, the body layer having a moisture level of at least about 13 wt. % to provide a grammage of the calendered release paper of from about 50 to about 90 g/m$^2$;

surface sizing the calendered release paper with a surface sizing treatment agent to provide a surface sized release paper, the quantity of the surface sizing treatment agent being less than about 0.7 g/m$^2$ as dry solids to form the surface sized release paper; and calendering the surfaced sized release paper to form a calendered sized release paper, the calendered release paper having pores which will not absorb the surface sizing treatment agent when the treatment agent is applied thereto as compared to a paper from the same body layer which has not been calendered with a moisture level of at least 13 weight percent and which has been surface sized with less than about 0.7 $g/m^2$ surface treating agent.

9. The method according to claim 8, wherein the body layer is calendered in a supercalender or a multinip calender.

10. The method according to claim 8, wherein the body layer is calendered in a shoe calender or a belt calender.

11. The method according to claim 8, wherein the quantity of the surface sizing agent is less than about 0.5 $g/m^2$.

12. The method according to claim 8, wherein the method further includes applying a release composition to the sized surface of the calendered sized release paper to provide a release agent surface, the release agent surface not absorbing an adhesive when an adhesive is applied thereto as much as a release paper from the same body layer which has not been calendered with a moisture level of at least 13 weight percent, which has been surface sized with less than about 0.7 $g/m^2$ surface treating agent and which has not been coated with same amount of a release agent in the same way.

13. The method according to claim 12, wherein the quantity of the surface sizing agent is less than about 0.5 $g/m^2$.

14. In a method for manufacturing a surface sized glassine release paper, the method comprising:

calendering a body layer in a calender that includes at least one nip formed between a hard-faced roll and a soft counter surface to provide a calendered glassine release paper, the calendered glassine release paper comprising chemical pulp made from a source pulp selected from the group consisting of softwood pulp, hardwood pulp and mixtures thereof, the body layer having a moisture level of at least about 13 wt. % to provide a grammage of the calendered glassine release paper of from about 50 to about 90 $g/m^2$; and surface sizing at least one surface of the calendered glassine release paper with a surface sizing treatment agent to provide a surface sized glassine release paper, the quantity of the surface sizing treatment agent being less than about 0.7 $g/m^2$ as dry solids to form the surface sized glassine release paper, the calendered glassine release paper having pores which will not absorb the surface sizing treatment agent when the treatment agent is applied thereto as compared to a glassine paper from the same body layer which has not been calendered with a moisture level of at least 13 weight percent and which has been surface sized with less than about 0.7 $g/m^2$ surface treating agent.

15. The method according to claim 14, wherein the method further includes calendering the surfaced sized glassine release paper to form a calendered sized glassine release paper.

16. The method according to claim 14, wherein the method further includes applying a release composition to the sized surface of the glassine release paper to provide a release agent surface, the release agent surface not absorbing an adhesive when an adhesive is applied thereto as much as a glassine paper from the same body layer which has not been calendered with a moisture level of at least 13 weight percent, which has been surface sized with less than about 0.7 $g/m^2$ surface treating agent and which has not been coated with same amount of a release agent in the same way.

17. The method according to claim 14, wherein the quantity of the surface sizing agent is less than about 0.5 $g/m^2$.

18. The method according to claim 16, wherein the quantity of the surface sizing agent is less than about 0.5 $g/m^2$.

* * * * *